2/11/86 XE 4,569,894

United States Patent [19]

Saitoh et al.

[11] Patent Number: 4,569,894

[45] Date of Patent: Feb. 11, 1986

[54] PHOTOCONDUCTIVE MEMBER COMPRISING GERMANIUM ATOMS

[75] Inventors: Keishi Saitoh, Tokyo; Kozo Arao, Yokohama, both of Japan

[73] Assignee: Canon Kabushiki Kaisha, Tokyo, Japan

[21] Appl. No.: 570,031

[22] Filed: Jan. 11, 1984

[30] Foreign Application Priority Data

Jan. 14, 1983 [JP] Japan ..... 58-5053
Jan. 14, 1983 [JP] Japan ..... 58-5054

[51] Int. Cl.[4] ..... G03G 5/082
[52] U.S. Cl. ..... 430/63; 430/84; 430/95
[58] Field of Search ..... 430/56, 84, 135, 63, 430/84, 95

[56] References Cited

U.S. PATENT DOCUMENTS

| | | | |
|---|---|---|---|
| 4,217,374 | 8/1980 | Ovshinsky | 430/57 |
| 4,357,179 | 11/1982 | Adams et al. | 430/135 |
| 4,469,715 | 9/1984 | Madan | 427/95 |
| 4,490,453 | 12/1984 | Shirai et al. | 430/57 |
| 4,491,626 | 1/1985 | Kawamura et al. | 430/60 |
| 4,495,262 | 1/1985 | Matsuzaki et al. | 430/95 |

*Primary Examiner*—John L. Goodrow
*Attorney, Agent, or Firm*—Fitzpatrick, Cella, Harper & Scinto

[57] ABSTRACT

A photoconductive member comprises a support and a light receiving layer comprising a first layer region comprising at least germanium atoms and being crystallized at least a portion thereof, a second region comprising an amorphous material comprising at least both of silicon atoms and germanium atoms and a third layer region comprising an amorphous material comprising at least silicon atoms, and exhibiting photoconductivity said layer regions being provided successively in this order from the said support side.

35 Claims, 2 Drawing Figures

PHOTOCONDUCTIVE MEMBER COMPRISING GERMANIUM ATOMS

BACKGROUND OF THE INVENTION

1. Field of the Invention

This invention relates to a photoconductive member having sensitivity to electromagnetic waves such as light (herein used in a broad sense, including ultraviolet rays, visible light, infrared rays, X-rays, gamma-rays and the like).

2. Description of the Prior Arts

Photoconductive materials, which constitute image forming members for electrophotography in solid state image pick-up devices or in the field of image formation, or photoconductive layers in manuscript reading devices, are required to have a high sensitivity, a high SN ratio (Photocurrent ($I_p$)/Dark current ($I_d$)), spectral characteristics matching to those of electromagnetic waves to be irradiated, a rapid response to light, a desired dark resistance value as well as no harm to human bodies during usage. Further, in a solid state image pick-up device, it is also required that the residual image should easily be treated within a predetermined time. In particular, in case of an image forming member for electrophotography to be assembled in an electrophotographic device to be used in an office as office apparatus, the aforesaid harmless characteristic is very important.

From the standpoint as mentioned above, amorphous silicon (hereinafter referred to as a-Si) has recently attracted attention as a photoconductive material. For example, German Laid-Open Patent Publication Nos. 2746967 and 2855718 disclose applications of a-Si for use in image forming members for electrophotography, and German Laid-Open Patent Publication No. 2933411 an application of a-Si for use in a photoconverting reading device.

However, under the present situation, the photoconductive members having photoconductive layers constituted of a-Si are further required to be improved in a balance of overall characteristics including electrical, optical and photoconductive characteristics such as dark resistance value, photosensitivity and response to light, etc., and environmental characteristics during use such as humidity resistance, and further stability with lapse of time.

For instance, when applied in an image forming member for electrophotography, residual potential is frequently observed to remain during use thereof if improvements to higher photosensitivity and higher dark resistance are scheduled to be effected at the same time. When such a photoconductive member is repeatedly used for a long time, there will be caused various inconveniences such as accumulation of fatigues by repeated uses or so-called ghost phenomenon wherein residual images are formed, or when it is used at a high speed repeatedly, response is gradually lowered.

Further, a-Si has a relatively smaller absorption coefficient in the wavelength region longer than the longer wavelength region side in the visible light region as compared with that on the shorter wavelength region side, and therefore in matching to the semiconductor laser practically used at the present time or when using a presently available halogen lamp or fluorescent lamp as the light source, there remains room for improvement in that the light on the longer wavelength side cannot effectively be used.

Besides, when the light irradiated cannot sufficiently be absorbed into the photoconductive layer but the dosage of the light reaching the support is increased, if the support itself has a high reflectance of the light permeating through the photoconductive member, there will occur interference due to multiple reflections which may be a cause for formation of "unfocused image".

This effect becomes greater, if the spot irradiated is made smaller in order to enhance resolution, and it is a great problem particularly when using a semiconductor laser as light source.

Further, a-Si materials may contain as constituent atoms hydrogen atoms or halogen atoms such as fluorine atoms, chlorine atoms, etc. for improving their electrical, photoconductive characteristics, boron atoms, phosphorus atoms, etc. for controlling the electroconduction type as well as other atoms for improving other characteristics. Depending on the manner in which these constituent atoms are contained, there may sometimes be caused problems with respect to electrical, photoconductive characteristics of the layer formed.

That is, for example, in many cases, the life of the photocarriers generated by light irradiation in the photoconductive layer formed is insufficient, or at the dark portion, the charges injected from the support side cannot sufficiently be impeded.

On the other hand, in view of matching to semiconductor laser, it has also been proposed to provide a light receiving layer constituted of an amorphous material containing at least germanium atoms. However, in this case, problems are sometimes involved in adhesion between the support and the light receiving layer and diffusion of impurities from the support to the light receiving layer.

Thus, it is required in designing of a photoconductive material to make efforts to overcome all of the problems as mentioned above along with the improvement of a-Si materials per se.

In view of the above points, the present invention contemplates the achievement obtained as a result of extensive studies made comprehensively from the standpoints of applicability and utility of a-Si as a photoconductive member for image forming members for electrophotography, solid state image pick-up devices, reading devices, etc. It has now been found that a photoconductive member having a layer constitution of photoconductive layer comprising a light receiving layer exhibiting photoconductivity, which is constituted of so-called hydrogenated amorphous silicon, halogenated amorphous silicon or halogen-containing hydrogenated amorphous silicon which is an amorphous material comprising a-Si, especially silicon atoms as a matrix and at least one of hydrogen atom (H) and halogen atom (X) (hereinafter referred to comprehensively as a-Si(H,X)), said photoconductive member being prepared by designing so as to have a specific structure as hereinafter described, is found to exhibit not only practically extremely excellent characteristics but also surpass the photoconductive members of the prior art in substantially all respects, especially having markedly excellent characteristics as a photoconductive member for electrophotography as well as excellent absorption characteristics on the longer wavelength side. The present invention is achieved based on such finding.

SUMMARY OF THE INVENTION

An object of the present invention is to provide a photoconductive member having electrical, optical and photoconductive characteristics which are constantly stable and all-environment type with virtually no dependence on the environments under use, which member is markedly excellent in light fatigue resistance without causing deterioration phenomenon when used repeatedly, exhibiting no or substantially no residual potential observed.

Another object of the present invention is to provide a photoconductive member which is high in photosensitivity in all visible light regions, particularly excellent in matching to semiconductor laser and rapid in light response.

Still another object of the present invention is to provide a photoconductive member having excellent electrophotographic characteristics, which is sufficiently capable of retaining charges at the time of charging treatment for formation of electrostatic charges to the extent such that a conventional electrophotographic method can be very effectively applied when it is provided for use as an image forming member for electrophotography.

Further object of the present invention is to provide a photoconductive member for electrophotography capable of providing easily a high quality image which is high in density, clear in halftone and high in resolution.

Still further object of the present invention is to provide a photoconductive member having high photosensitivity and high SN ratio characteristic.

According to the present invention, there is provided a photoconductive member, comprising a support and a light receiving layer comprising a first layer region comprising at least germanium atoms of which and being crystallized at least in a portion thereof a second region comprising an amorphous material comprising at least silicon atoms and germanium atoms and a third layer region comprising an amorphous material comprising at least silicon atoms and exhibiting photoconductivity, said layer regions being provided successively in this order from the said support side.

DESCRIPTION OF THE PREFERRED EMBODIMENTS

Figure 1:
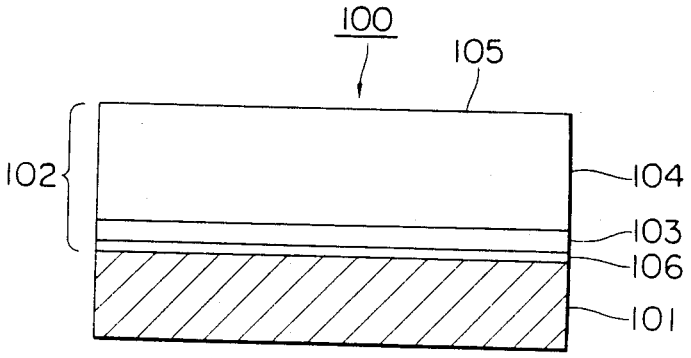
FIG. 1 shows a schematic sectional view for illustration of the layer constitution of the photoconductive member according to the present invention.

Referring now to the drawings, the photoconductive members according to the present invention are to be described in detail below.

FIG. 1 shows a schematic sectional view for illustration of the layer constitution of a first embodiment of the photoconductive member of this invention.

The photoconductive member 100 as shown in FIG. 1 has a light receiving layer 102 on a support 101 for photoconductive member, said light receiving layer 102 having a free surface 105 on one of the outer surfaces. The light receiving layer 102 has a layer structure in which a first layer region (C) 106 comprising a material at least partially crystallized comprising of only germanium atoms or germanium atoms and silicon atoms as a matrix and optionally either hydrogen atoms or halogen atoms (hereinafter abbreviated as "μc-Ge(Si,H,X)"), a second layer 103 comprising a-Si(H,X) comprising germanium atoms (hereinafter abbreviated as "a-Si Ge(H,X)" and a third layer region (S) 104 comprising a-Si(H,X) and having photoconductivity are successively laminated from the side of the support 101.

When the first layer region (C) 106 is constituted of a material comprising germanium atoms and silicon atoms as a matrix, the germanium atoms and silicon atoms are contained in a distribution continuous and uniform in the layer thickness direction of said first layer region (C) 106 and in the direction substantially parallel to the surface of the support 101.

The germanium atoms contained in the second layer region (G) 103 are distributed in said layer region (G) 103 in a distribution continuous and uniform in the layer thickness direction of said second layer region (G) 103 and in the direction substantially parallel to the surface of the support 101.

In the photoconductive member 100 of the present invention, a substance (D) for controlling the conductive characteristic is contained preferably in at least the first layer region (C) 106 or the second layer region (G) 103, particularly desirably in the second layer region (G) 103 in order to impart a desirable conductive characteristic.

In such a case, the substance (D) for controlling the electroconductive characteristics to be contained in the first layer region (C) 106 or the second layer region (G) 103 may be contained evenly within the whole of the first layer region (C) 106 or the second layer region (G) 103, or alternatively locally in a part of the first layer region (C) 106 or the second layer region (G) 103.

When the substance (D) for controlling the electroconductive characteristics is particularly incorporated locally in a part of the second layer region (G) 103 in the present invention, the layer region (PN) containing the aforesaid substance (D) may desirably be provided as an end portion region of the second layer region (G). In particular, when the aforesaid layer region (PN) is provided as the end portion layer region on the support side of the second layer region (G), injection of charges of a specific polarity from the support into the light-receiving layer can be effectively inhibited by selecting suitably the kind and the content of the aforesaid substance (D) to be contained in said layer region (PN).

In the photoconductive member of the present invention, the substance (D) capable of controlling the conductive characteristics may be incorporated in the second layer region (G) constituting a part of the light receiving layer either evenly throughout the whole region or locally in the direction of layer thickness. Further, alternatively, the aforesaid substance (D) may also be incorporated in the third layer region (S) provided on the second layer region (G).

When the aforesaid substance (D) is to be incorporated in the third layer region (S), the kind and the content of the substance (D) to be incorporated in the third layer region (S) as well as its mode of incorporation may be determined suitably depending on the kind and the content of the substance (D) incorporated in the second layer region (G) as well as its mode of incorporation.

When the aforesaid substance (D) is to be incorporated in the third layer region (S), it is preferred that the aforesaid substance (D) should be incorporated within the layer region containing at least the contact interface with the second layer region (G).

The aforesaid substance (D) may be contained evenly throughout the whole layer region of the third layer region (S) or alternatively uniformly in a part of the layer region.

When the substance (D) for controlling the electroconductive characteristics is to be incorporated in both of the second layer region (G) and the third layer region (S), it is preferred that the layer region containing the aforesaid substance (D) in the second layer region (G) and the layer region containing the aforesaid substance (D) in the third layer region (S) may be contacted with each other.

Also, when the aforesaid substance (D) is contained in the first layer region (C), the second layer region (G) and the third layer region (S), said substance (D) may be either the same or different in the first layer region (C), the second layer region (G) and the third layer region (S), and their contents may also be the same or differnt in respective layer regions.

However, it is preferred that the content in the second layer region should be made sufficiently greater when the same kind of the aforesaid substance (D) is employed in respective three layer regions, or that different kinds of substance (D) with different electrical characteristics should be incorporated in respective desired layer regions.

By incorporating the substance (D) for controlling the conductive characteristics in at least the second layer region (G) constituting the light-receiving layer, the electroconductive charactertistics of the layer region containing said substance (D) (either a part or whole of the second layer region (G)) can freely be controlled as desired. As such a substance (D), there may be mentioned so-called impurities in the art of semiconductors. In the present invention, there may be included p-type impurities giving p-type electroconductive characteristics and n-type impurities giving n-type electroconductive characteristics to Si and Ge comprising the light-receiving layer to be formed.

More specifically, there may be mentioned as p-type impurities atoms belonging to the group III atoms of the periodic table, such as B (boron), Al (aluminum), Ga (gallium), In (indium), Tl (thallium), etc., particularly preferably B and Ga.

As n-type impurities, there may be included the atoms belonging to the group V atoms of the periodic table, such as P (phosphorus), As (arsenic), Sb (antimony), Bi (bismuth), etc., particularly preferably P and As.

In the present invention, the content of the substance (D) for controlling the electroconductive characteristics in said layer region (PN) may be suitably be selected depending on the electroconductive characteristics required for said layer region (PN), or when said layer region (PN) is provided in direct contact with the support, depending on the organic relation such as the relation with the characteristics at the contacted interface with the support.

The content of the substance for controlling the conductive characteristics may be suitably selected also with consideration about other layer regions provided in direct contact with said layer region (PN) and the relationship with the characteristics at the contacted interface with said other layer regions.

The content of the substance (D) for controlling the electroconductive characteristics in the layer region (PN) may be preferably 0.01 to $5\times10^4$ atomic ppm, more preferably 0.5 to $1\times10^4$ atomic ppm, most preferably 1 to $5\times10^3$ atomic ppm.

By making the content of the substance (D) for controlling the electroconductive characteristics in the layer region (PN) preferably 30 atomic ppm or more, more preferably 50 atomic ppm or more, most preferably 100 atomic ppm or more, in case, for example, when said substance (D) to be incorporated is a p-type impurity, at least injection of electrons from the support side through the second layer region (G) into the third layer region (S) layer can be effectively inhibited when the free surface of the light receiving layer is subjected to the charging treatment at ⊕ polarity, or in case when the aforesaid substance (D) to be incorporated is an n-type impurity, at least injection of holes from the support side through the second layer region (G) into the third layer region (S) can be effectively inhibited when the free surface of the light-receiving layer is subjected to the charging treatment at ⊖ polarity.

In the above cases, as described previously, the layer region (Z) excluding the aforesaid layer region (PN) may contain a substance for controlling the electroconductive characteristics with a conduction type of a polarity different from that of the substance for controlling the characteristics contained in the layer region (PN), or a substance for controlling the electroconductive characteristics with a conduction type of the same polarity in an amount by far smaller than the practical amount to be contained in the layer region (PN).

In such a case, the content of the substance for controlling the conductive characteristics to be contained in the aforesaid layer region (Z), which may suitably be determined as desired depending on the polarity and the content of the aforesaid substance contained in the aforesaid substance, may be preferably 0.001 to 1000 atomic ppm, more preferably 0.05 to 500 atomic ppm, most preferably 0.1 to 200 atomic ppm.

When the same kind of the substance (C) for controlling the conductive characteristics in the layer region (PN) and the layer region (Z), the content in the layer region (Z) may preferably be 30 atomic ppm or less.

By providing in the light receiving layer a layer region containing a substance for controlling the electroconductive characteristics having a conduction type of one polarity and a layer region containing a substance for controlling the electroconductive characteristics having a conduction type of the other polarity in direct contact with each other, there can also be provided a so-called depleted layer at said contacted region.

In short, for example, a depleted layer can be provided in the amorphous layer by providing a layer region containing the aforesaid p-type impurity and a layer region containing the aforesaid n-type impurity so as to be directly contacted with each other thereby to form a so-called p-n junction.

In the present invention, no germanium atom is contained in the third layer region (S) provided on the second layer region (G), and by forming a light-receiving layer to such a structure, there can be obtained a photosensitive member which is excellent in photosensitivity to the light with wavelengths over all the region from short wavelength to relatively longer wavelength.

Also, since the germanium atoms are distributed in the first layer region (C) in such a state that the germanium atoms are continuously distributed throughout the entire layer region, when using a light source such as semiconductor laser, an affinity between the first layer region (C) and the second layer region (S) can be ensured excellent and the light on the longer wavelength side which cannot substantially be absorbed by the third layer region (S) can be substantially completely absorbed in the first layer region (G), whereby the interference by reflection from the support surface can be prevented.

Also, in the photoconductive member of the present invention, since each of the materials constituting the second layer region (G) and the third layer region (S) comprises common constituent elements of silicon atoms and germanium atoms, chemical stability can sufficiently be ensured at the laminated interface.

In the present invention, the content of germanium atoms contained in the first layer region (C) can be determined as desired so that the objects of the present invention can be accomplished effectively, but generally 1 to $1\times10^6$ atomic ppm, preferably 100 to $1\times10^6$ atomic ppm, most preferably 500 to $1\times10^6$ atomic ppm.

The content of germanium atoms contained in the second layer region (G) may be determined as desired so that the objects of the present invention may effectively be accomplished, but preferably 1 to $9.5\times10^5$ atomic ppm, more preferably 100 to $8\times10^5$ atomic ppm, most preferably 500 to $7\times10^5$ atomic ppm.

In the present invention, sufficient care should be paid in designing of the photoconductive member to the layer thicknesses of the first layer region (C) and the second layer region (G), which are one of important factors to accomplish effectively the objects of the present invention, so that desired characteristics may sufficiently given to the photoconductive member formed.

In the present invention, the layer thickness of the first layer region (C) should preferably be 30 Å to 50μ, more preferably 40 Å to 40μ, most preferably 50 Å to 30μ.

On the other hand, the layer thickness $T_B$ of the second layer region (G) should preferably be 30 Å to 50 μ, more preferably 40 Å to 40μ, most preferably 50 Å to 30μ.

Further, the layer thickness T of the third layer region (S) should preferably be 0.5 to 90μ, more preferably 1 to 80μ, most preferably 2 to 50μ. The sum of the layer thickness $T_B$ of the second layer region (G) and the thickness T of the third layer region (S), namely $(T_B+T)$ is determined suitably as desired during layer design of the photoconductive member, based on the relationships mutually between the characteristics required for the both layer regions and the characteristics required for the light receiving layer as a whole.

In the photoconductive member, the numerical range of the above $(T_B+T)$ may preferably be 1 to 100μ, more preferably 1 to 80μ, most preferably 2 to 50μ.

In more preferable embodiments of the present invention, it is desirable to select suitably appropriate numerical values for the above layer thicknesses $T_B$ and T, while satisfying preferably the relation of $T_B/T\leqq1$.

In selection of the numerical values of the layer thickness $T_B$ and the layer thickness T in the above-mentioned case, the values of the layer thickness $T_B$ and the layer thickness T should desirably be determined, while satisfying more preferably the relation of $T_B/T\leqq0.9$, most preferably the relation of $T_B/T\leqq0.8$.

In the present invention, when the content of the germanium atoms in the first layer region (C) is $1\times10^5$ atomic ppm or more, the layer thickness of the first layer region (C) is desired to be made considerably thin, preferably 30μ or less, more preferably 25μ or less, most preferably 20μ or less.

Typical examples of the halogen atom (X) to be incorporated, if desired, in the first layer region (C), the second layer region (G) and the third layer region (S) may definitely include fluorine, chlorine, bromine and iodine, particularly preferably fluorine and chlorine.

In the present invention, formation of a first layer region (C) comprising μc-Ge(Si,H,X) may be conducted according to the vacuum deposition method utilizing a discharging phenomenon, such as glow discharge method, sputtering method, ion-plating method and the like and vacuum vapor deposition method. For example, for formation of the first layer region (C) comprising μc-Ge(Si,H,X) according to the glow discharge method, the basic procedure comprises introducing a starting gas for Ge supply capable of supplying germanium atoms (Ge) and a starting gas for Si supply capable of supplying silicon atoms (Si) together with, if necessary, a starting gas for introduction of hydrogen atoms or/and halogen atoms into the deposition chamber which can be internally brought to a reduced pressure, and exciting glow discharge in said deposition chamber, thereby forming a layer consisting of μc-Ge(Si,H,X) on the surface of a support set at a predetermined position. Alternatively, for formation of the first layer region (C) according to the sputtering method, by use of one sheet of a target constituted of Ge and a target constituted of Si, two sheets of target comprising said target and a target constituted of Ge, or one sheet of target comprising a mixture of Si and Ge, a a starting gas for Ge supply optionally diluted with a diluting gas such as Ar, He, etc. may be introduced together with, if necessary, a gas for introduction of hydrogen atoms (H) or/and halogen atoms (X) into the deposition chamber for sputtering to form a desired gas plasma atmosphere, followed by sputtering of the aforesaid target therein.

In the case of the ion plating method, except for using, for example, a polycrystalline germanium or a single crystalline germanium and, if necessary, a polycrystalline silicone or a single crystalline silicon, placing each material in a vapor deposition boat, heating the vaporizable source according to the resistance heating method or the electron beam method (EB method) to vaporize the material and permitting the flying vaporized product to pass through a desired gas plasma atmosphere, the same procedure can be followed as in the case of sputtering.

In formation of the first layer region (C), the support temperature is required to be higher by 50° C. to 200° C. than that in formation of the second layer region (G).

Formation of the second layer region (G) comprising a-SiGe(H,X) may be conducted according to the vacuum deposition method utilizing discharging phenomenon, such as glow discharge method, sputtering method, ion-plating method and the like. For example, for formation of the second layer region (G) comprising a-SiGe(H,X) according to the glow discharge method, the basic procedure comprises introducing a starting gas for Si supply capable of supplying silicon atoms (Si) and a starting gas for Ge supply capable of supplying germanium atoms (Ge) together with, if necessary, a starting gas for introduction of hydrogen atoms or/and halogen atoms into the deposition chamber which can be internally brought to a reduced pressure, and exciting glow discharge in said deposition chamber, thereby forming a layer consisting of a-SiGe(H,X) on the surface of a support set at a predetermined position. Alternatively, for formation of the first layer region (G) according to the sputtering method, by use of one sheet of a target constituted of Ge and a target constituted of Si, two sheets of target comprising said target and a target constituted of Ge, or one sheet of a target comprising a mixture of Si and Ge, a starting gas for Ge supply optionally diluted with a diluting gas such as Ar, He, etc. may be introduced together with, if necessary, a gas for introduction of hydrogen atoms (H) or/and halogen atoms (X) into the deposition chamber for sputtering to form a desired gas plasma atmosphere, followed by sputtering of the aforesaid target therein.

In the case of the ion plating method except for using, for example, a polycrystalline germanium or a single crystalline germanium and, if necessary, a polycrystalline silicon or a single crystalline silicon, placing each material in a vapor deposition boat, heating the vaporizable source according to the resistance heating method or the electron beam method (EB method) to vaporize the material and permitting the flying vaporized product to pass through a desired gas plasma atmosphere, the same procedure can be followed as in the case of sputtering.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

As the substances which can be used as starting gases for Ge supply, there may be included gaseous or gasifiable hydrogenated germanium compounds such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$ and the like as effective ones. In particular, for easiness in handling during layer forming operations and efficiency in supplying $GeH_4$, $Ge_2H_6$ and $Ge_3H_8$ are preferred.

Effective starting gases for introduction of halogen atoms to be used in the present invention may include a large number of halogen compounds, as exemplified by halogen gases, halides, interhalogen compounds, or gaseous or gasifiable halogen compounds such as silane derivatives substituted with halogens.

Further, there may also be included gaseous or gasifiable silicon compounds containing halogen atoms constituted of silicon atoms and halogen atoms as constituent elements as effective ones in the present invention.

Typical examples of halogen compounds preferably used in the present invention may include halogen gases such as of fluorine, chlorine, bromine or iodine, interhalogen compounds such as BrF, ClF, $ClF_3$, $BrF_5$, $BrF_3$, $IF_3$, $IF_7$, ICl, IBr, etc.

As the silicon compounds containing halogen atoms namely so called silane derivatives substituted with halogens, there may preferably be employed silicon halides such as $SiF_4$, $Si_2F_6$, $SiCl_4$, $SiBr_4$ and the like.

When the characteristic photoconductive member of the present invention is to be formed according to the glow discharge method by employment of such a silicon compound containing halogen atoms, it is possible to form a first layer region (C) and a second layer region (G) on a desired support without use of a hydrogenated silicon gas as the starting material capable of supplying Si together with a starting gas for Ge supply.

For formation of a first layer region (C) and a second layer region (G) containing halogen atoms according to the glow discharge method, the basic procedure comprises introducing a silicon halide gas as the starting gas for Si supply, a hydrogenated germanium as the starting gas for Ge supply and a gas such as Ar, $H_2$, etc. at a predetermined mixing ratio and gas flow rates into a deposition chamber for formation of the first layer region (C) and the second layer region (G) and exciting glow discharging therein to form a plasma atmosphere of these gases, whereby the first layer region (C) and the second layer region (G) can be formed on a desired support. For the purpose of controlling more easily the ratio of hydrogen atoms introduced, these gases may further be admixed at a desired level with hydrogen gas or a gas of a silicon compound containing hydrogen atoms.

Also, the respective gases may be used not only as single species but as a mixture of plural species in predetermined ratio.

In either of the sputtering method or the ion plating method, introduction of halogen atoms into the layer formed may be effected by introducing a gas of a halogen compound or a silicon compound containing halogen atoms as described above into the deposition chamber and forming a plasma atmosphere of said gas.

Also, for introduction of hydrogen atoms, a starting gas for introduction of hydrogen atoms, such as $H_2$, or a gas of silanes or/and hydrogenated germanium such as those mentioned above may be introduced into the deposition chamber and a plasma atmosphere of said gas may be formed therein.

In the present invention, as the starting gas for introduction of halogen atoms, the halogen compounds or silicon compounds containing halogens as mentioned above can effectively be used. In addition, it is also possible to use a gaseous or gasifiable halides containing hydrogen atoms as a constituent atom, such as hydrogen halide, including HF, HCl, HBr, HI and the like or halo-substituted hydrogenated silicon, including $SiH_2F_2$, $SiH_2I_2$, $SiH_2Cl_2$, $SiHCl_3$, $SiH_2Br_2$, $SiHBr_3$ and the like, hydrogenated germanium halides such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, $GeH_3I$ and the like, and germanium halides such as $GeF_4$, $GeCl_4$, $GeBr_4$, $GeI_4$, $GeF_2$, $GeCl_2$, $GeBr_2$, $GeI_2$, and so on, as an effective starting material for formation of the first layer region (C) and the second layer region (G).

Among these substances, halides containing hydrogen atoms, which can introduce hydrogen atoms very effective for controlling electrical or photoelectric characteristics into the layer during formation of the first layer region (C) and the second layer region (G) simultaneously with introduction of halogen atoms, can preferably be used as the starting material for introduction of halogen atoms.

For incorporation of hydrogen atoms structurally into the first layer region (C) and the second layer region (G), other than the above method, $H_2$ or a gas of hydrogenated silicon, including $SiH_4$, $Si_2H_6$, $Si_3H_8$, $Si_4H_{10}$ and the like and germanium or a germanium compound for supplying Ge, or alternatively a hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$ and the like and silicon or a silicon compound for supplying Si may be permitted to be co-present in a deposition chamber, wherein discharging is excited.

In preferred embodiments of this invention, the amount of hydrogen atoms (H), halogen atoms (X) or total amount (H+X), incorporated in the first layer region (C) constituting the photoconductive member formed, may be preferably 0.0001 to 40 atomic %, more preferably 0.005 to 30 atomic %, most preferably 0.01 to 25 atomic %.

For controlling the amounts of hydrogen atoms (H) or/and halogen atoms (X) in the first layer region (C), the support temperature or/and the amounts of the starting materials for incorporation of hydrogen atoms (H) or halogen atoms (X) to be introduced into the deposition device system or the discharging power may be controlled.

In preferred embodiments of this invention, the amount of hydrogen atoms (H) or halogen atoms (X) incorporated in the second layer region (G) constituting the photoconductive member formed, or total amount (H+X), may be preferably 0.01 to 40 atomic %, more preferably 0.05 to 30 atomic %, most preferably 0.1 to 25 atomic %.

For controlling the amounts of hydrogen atoms (H) or/and halogen atoms (X) in the second layer region (G), the support temperature or/and the amounts of the starting materials for incorporation of hydrogen atoms (H) or halogen atoms (X) to be introduced into the deposition device system or the discharging power may be controlled.

In the present invention, for formation of the third layer region (S) formed of a-Si(H,X), the starting materials selected from among the starting materials (I) for formation of the second layer region (G) as described above except for the starting material as the starting gas for Ge supply (the starting materials (II) for formation of the third layer region (S)) may be employed, following the same method and conditions in case of formation of the second layer region (G).

That is, in the present invention, formation of the third layer region (S) formed of a-Si(H,X) may be conducted according to the vacuum deposition method utilizing discharging phenomenon, such as glow discharge method, sputtering method or ion-plating method. For example, for formation of the third layer region (S) constituted of a-Si(H,X) according to the glow discharge method, the basic procedure comprises introducing a starting gas for Si supply capable of supplying silicon atoms (Si) together with, if necessary, a starting gas for introduction of hydrogen atoms (H) or/and halogen atoms (X) into the deposition chamber which can be internally brought to a reduced pressure, and exciting glow discharge in said deposition chamber, thereby forming a layer consisting of a-Si(H,X) on the surface of a support set at a predetermined position. For formation of the layer according to the sputtering method, when effecting sputtering by use of a target constituted of Si in an atmosphere of, for example, an inert gas such as Ar, He, etc. or a gas mixture based on these gases, a gas for introduction of hydrogen atoms (H) or/and halogen atoms (X) may be introduced into the deposition chamber for sputtering.

In the present invention, the amount of hydrogen atoms (H) or halogen atoms (X) or the sum of hydrogen atoms and halogen atoms (H+X) contained in the third layer region (S) comprising the light-receiving member may preferably 1 to 40 atomic %, more preferably 5 to 30 atomic %, most preferably 5 to 25 atomic %.

For formation of the layer region (PN) containing the aforesaid substance (D) by introducing structurally the substance (D) for controlling the electroconductive characteristics, for example, the group III atoms or the group V atoms of the periodic table into the layer region constituting the light-receiving layer, a starting material for introduction of the group III atoms of the periodic table or a starting material for introduction of the group V atoms of the periodic table may be introduced under gaseous state into the deposition chamber together with other starting materials for formation of the light-receiving layer. As such starting materials for introduction of the group III atoms of the periodic table, there may preferably be used gaseous or at least gasifiable compounds under the layer forming conditions. Typical examples of such starting materials for introduction of the group III atoms may include hydrogenated boron such as $B_2H_6$, $B_4H_{10}$, $B_5H_9$, $B_5H_{11}$, $B_6H_{10}$, $B_6H_{12}$, $B_6H_{14}$ and the like, boron halides such as $BF_3$, $BCl_3$, $BBr_3$ and the like for introduction of boron atoms. In addition, there may also be employed $AlCl_3$, $GaCl_3$, $Ga(CH_3)_3$, $InCl_3$, $TlCl_3$, etc.

As the starting material for introduction of the group V atoms of the periodic table to be effectively used in the present invention, there may be mentioned hydrogenated phosphorus such as $PH_3$, $P_2H_4$ and the like, phosphorus halides such as $PH_4I$, $PF_3$, $PF_5$, $PCl_3$, $PCl_5$, $PBr_3$, $PBr_5$, $PI_3$ and the like for introduction of phosphorus atoms. In addition, there may also be included $AsH_3$, $AsF_3$, $AsCl_3$, $AsBr_3$, $AsF_5$, $SbH_3$, $SbF_3$, $SbF_5$, $SbCl_3$, $SbCl_5$, $SiH_3$, $SiCl_3$, $BiBr_3$, etc. also as effective starting materials for introduction of the group V atoms of the periodic table.

The support to be used in the present invention may be either electroconductive or dielectric. As the electroconductive material, there may be mentioned metals such as NiCr, stainless steel, Al, Cr, Mo, Au, Nb, Ta, V, Ti, Pt, Pd etc. or alloys thereof.

As dielectric supports, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. These dielectric supports should preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO-($IN_2O_3 \times SnO_2$) thereon. Alternatively, a synthetic resin film such as polyester film can be subjected to the electroconductive treatment on its surface by vacuum vapor deposition, electronbeam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The support may be shaped in any form such as cylinders, belts, plates or others, and its form may be determined as desired. For example, when the photoconductive member 100 in FIG. 1 is to be used as an image forming member for electrophotography, it may desirably be formed into an endless belt or a cylinder for use in continuous high speed copying. The support may have a thickness, which is conveniently determined so that a photoconductive member as desired may be formed. When the photoconductive member is required to have a flexibility, the support is made as thin as possible, so far as the function of a support can be exhibited. However, in such a case, the thickness is generally 10 μ or more from the points of fabrication and handling of the support as well as its mechanical strength.

As described in detail above, the photoconductive member designed to have layer constitution of the present invention can overcome all of the problems as mentioned above and exhibit very excellent electrical, optical, photoconductive characteristics, electrical pressure resistance as well as good environmental characteristics in use.

In particular, when it is applied as an image forming member for electrophotography, it is excellent in charge retentivity in charging treatment without any influence of residual potential on image formation at all, being stable in its electrical properties with high sensitivity and having high SN ratio as well as excellent light fatigue resistance and repeated usage characteristics, whereby it is possible to obtain images of high quality with high concentration, clear halftone and high resolution.

Further, the photoconductive member of the present invention is high in photosensitivity over the all visible light regions, particularly excellent in matching to semiconductor laser and also rapid in light response.

Next, an example of the process for producing the photoconductive member of this invention is to be briefly described.

Figure 2:
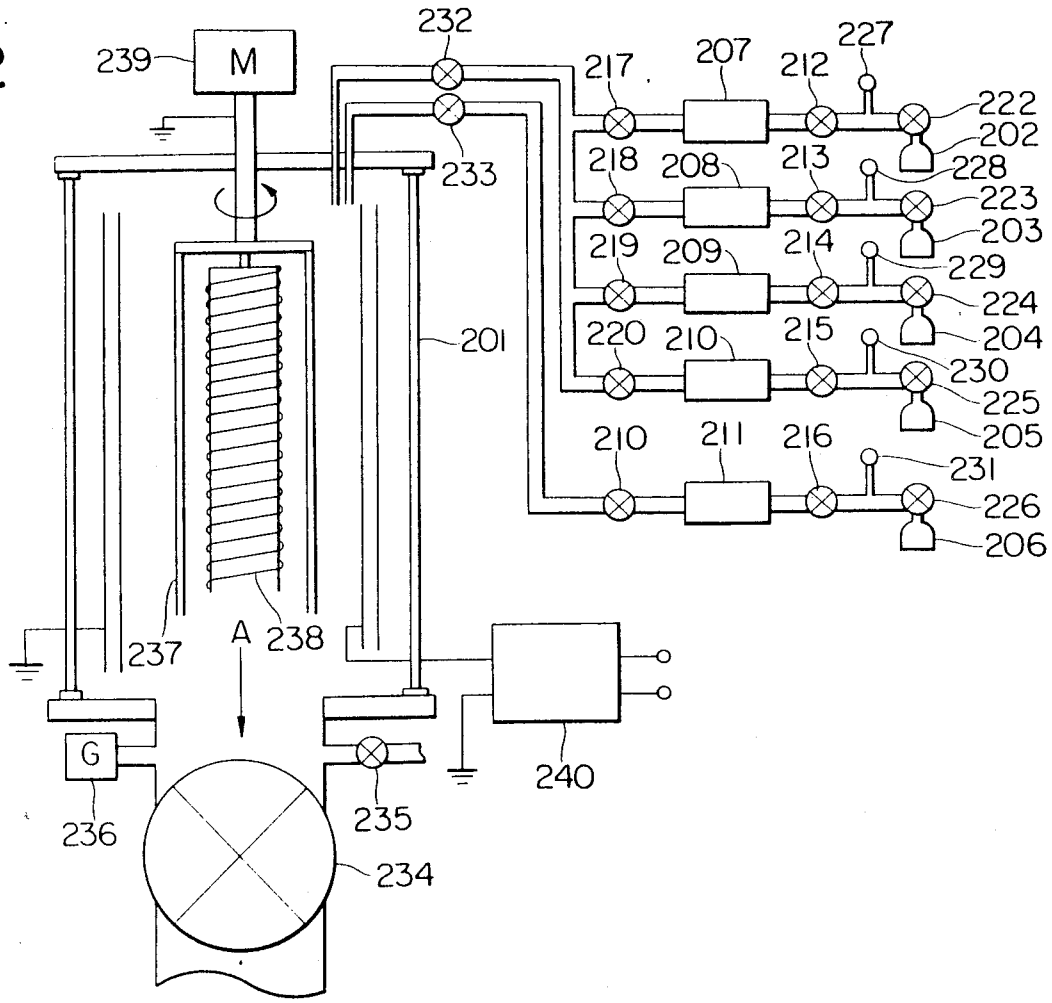
FIG. 2 is a schematic flow chart for illustration of the device used for preparation of the photoconductive member of the present invention.

FIG. 2 shows one example of a device for producing a photoconductive member.

In the gas bombs 202-206 there are hermetically contained starting gases for formation of the photoconductive member of the present invention. For example, 202 is a bomb containing $SiH_4$ gas diluted with He (purity: 99.999%, hereinafter abbreviated as "$SiH_4$/He"), 203 is a bomb containing $GeH_4$ gas diluted with He (purity 99.999%, hereinafter abbreviated as "$GeH_4$/He"), 204 is a bomb containing $SiF_4$ gas diluted with He (purity: 99.99% hereinafter abbreviated as "$SiH_4$/He"), 205 is a bomb containing $B_2H_6$ gas diluted with He (purity: 99.999% hereinafter abbreviated as "$B_2H_6$/He") and 206 is a $H_2$ gas bomb (purity: 99.999%).

For allowing these gases to flow into the reaction chamber 201, on confirmation of the valves 222-226 of the gas bombs 202-206 and the leak valve 235 to be closed, and the inflow valves 212-216, the outflow valves 217-221 and the auxiliary valves 232 and 233 to be opened, the main valve 234 is first opened to evacuate the reaction chamber 201 and the gas pipelines. As the next step, when the reading on the vacuum gauge 236 becomes $5\times10^{-6}$ Torr, the auxiliary valves 232 and 233 and the outflow valves 217-221 are closed.

Referring now to an example of forming a first layer region on the cylindrical substrate 237, $SiH_4$/He gas from the gas bomb 202, $GeH_4$/He gas from the gas bomb 203, $B_2H_6$/He gas from the gas bomb 205 are permitted to flow into the mass-flow controllers 207, 208 and 210, respectively, by opening the valves 222, 223 and 225 and controlling the pressures at the outlet pressure gauges 227, 228 and 230 to 1 kg/cm$^2$ and opening gradually the inflow valves 212, 213 and 215, respectively. Subsequently, the outflow valves 217, 218 and 220 and the auxiliary valve 232 are gradually opened to permit respective gases to flow into the reaction chamber 201. The outflow valves 217, 218 and 220 are controlled so that the flow rate ratio of $SiH_4$/He, $GeH_4$/He and $B_2H_6$/He may have a desired value and opening of the main valve 234 is also controlled while watching the reading on the vacuum gauge 236 so that the pressure in the reaction chamber may reach a desired value. And, after confirming that the temperature of the substrate 237 is set at 400°-600° C. by the heater 238, the power source 240 is set at a desired power to excite glow discharge in the reaction chamber 201 to form a first layer region (C) on the substrate 237. At the stage when the first layer region (C) is formed to a desired layer thickness, following the same conditions and the procedure except for setting the temperature of the substrate 237 by means of the heater 238 to 50°-400° C. and changing the discharging conditions, if desired, glow discharging is maintained for a desired period of time, whereby the second layer region (G) can be formed on the said first layer region (C).

At the stage when the second layer region (G) is formed to a desired layer thickness, following the same conditions and the procedure except for completely closing the outflow valve 218 and changing the discharging conditions, if desired, glow discharging is maintained for a desired period of time, whereby a third layer region (S) constituted of containing substantially no germanium atoms (Ge) can be formed on the second layer region.

For incorporating a substance (D) for controlling the electroconductive characteristic into the third layer region (S), gases such as $B_2H_6$, $PH_3$ and the like may be added to other gases to be introduced into the deposition chamber during formation of the third layer region (S).

Thus, a light receiving layer comprising the first layer region (C), the second layer region (G) and the third layer region (S) is formed on the substrate During layer formation, it is desirable to rotate the substrate 237 at a constant speed by the motor 239 in order to effect layer formation uniformly.

The present invention is further illustrated by referring to the following Examples.

EXAMPLE 1

By means of the device as shown in FIG. 2, layers were formed on a cylindrical aluminum substrate under the conditions shown in Table 1A below to obtain an image forming member for electrophotography.

The thus obtained image forming member was set in an experimental device for charging exposure and corona charging was effected at ⊖5.0 KV for 0.3 sec., followed immediately by irradiation of a light image. The light image was irradiated by use of a tungsten lamp light source at a dose of 2 lux. sec. through a transmissive type test chart.

Immediately thereafter, a positively charged developer (comprising toner and carrier) was cascaded on the surface of the image forming member to obtain a good toner image on the surface of the image forming member. When the toner image on the image forming member was transferred by ⊖5.0 KV corona charging to a transfer paper, a clear image of high density excellent in resolution with good gradation reproducibility was obtained.

EXAMPLE 2

By means of the device shown in FIG. 2, an image forming member for electrophotography was obtained by performing layer formation according to the same procedure as in Example 1 except for changing the conditions to those shown in Table 2A.

For the image forming member thus obtained, an image was formed on a transfer paper according to the same procedure and under the same conditions as in Example 1, except for changing the charging polarity and the charged polarity of the developer to opposite polarities, respectively, whereby a very clear image quality was obtained.

EXAMPLE 3

By means of the device shown in FIG. 2, an image forming member for electrophotography was obtained by performing layer formation according to the same procedure as in Example 1 except for changing the conditions to those shown in Table 3A.

For the image forming member thus obtained, an image was formed on a transfer paper according to the same procedure and under the same conditions as in Example 1, whereby a very clear image quality was obtained.

EXAMPLE 4

Image forming members for electrophotography were prepared, respectively, according to the same procedure as in Example 1 except for changing the contents of germanium atoms contained in the first layer as shown in Table 4A by varying the flow rate ratio of $GeH_4$/He gas to $SiH_4$/He gas.

For the image forming members thus obtained, images were formed on transfer papers according to the same procedure and under the same conditions as in Example 1 to obtain the results as shown in Table 4A.

EXAMPLE 5

Image forming members for electrophotography were prepared, respectively, according to the same procedure as in Example 1 except for changing the layer thickness of the first layer as shown in Table 5A.

For the image forming members thus obtained, images were formed on transfer papers according to the same procedure and under the same conditions as in Example 1 to obtain the results as shown in Table 5A.

EXAMPLE 6

By means of the device as shown in FIG. 2, layers were formed on a cylindrical aluminum substrate under the conditions shown in Table 6A to obtain an image forming member for electrophoto-graphy.

The thus obtained image forming member was set in an experimental device for charging exposure and corona charging was effected at ⊖5.0 KV for 0.3 sec., followed immediately by irradiation of a light image. The light image was irradiated by use of a tungsten lamp light source at a dose of 2 lux.sec through a transmissive type test chart.

Immediately thereafter, a positively charged developer (comprising toner and carrier) was cascaded on the surface of the image forming member to obtain a good toner image on the surface of the image forming member. When the toner image on the image forming member was transferred by ⊖5.0 KV corona charging to a transfer paper, a clear image of high density excellent in resolution with good gradation reproducibility was obtained.

EXAMPLE 7

In Example 1, an electrostatic image was formed by use of a GaAs type semiconductor laser having 810 nm wavelength (10 mW) was employed as the light source in place of the tungsten lamp, following otherwise the same toner image forming conditions as in Example 1, to prepare an image forming member for electrophotography. When image quality evaluation was conducted for the image forming member obtained, the image obtained was found to be excellent in resolution and of high quality, which was clear with good gradation reproducibility.

EXAMPLE 8

By means of the device as shown in FIG. 2, layers were formed on a cylindrical aluminum substrate under the conditions shown in Table 1B below to obtain an image forming member for electrophotography.

The thus obtained image forming member was set in an experimental device for charging exposure and corona charging was effected at ⊕5.0 KV for 0.3 sec., followed immediately by irradiation of a light image. The light image was irradiated by use of a tungsten lamp light source at a dose of 2 lux.sec through a transmissive type test chart.

Immediately thereafter, a negatively charged developer (comprising toner and carrier) was cascaded on the surface of the image forming member to obtain a good toner image on the surface of the image forming member. When the toner image on the image forming member was transferred by ⊕5.0 KV corona charging to a transfer paper, a clear image of high density excellent in resolution with good gradation reproducibility was obtained.

EXAMPLE 9

By means of the device shown in FIG. 2, an image forming member for electrophotography was obtained by performing layer formation according to the same procedure as in Example 8 except for changing the conditions to those shown in Table 2B.

For the image forming member thus obtained, an image was formed on a transfer paper according to the same procedure and under the same conditions as in Example 8, except for changing the charging polarity and the charged polarity of the developer to opposite polarities, resepctively, whereby a very clear image quality was obtained.

EXAMPLE 10

By means of the device shown in FIG. 2, an image forming member for electrophotography was obtained by performing layer formation according to the same procedure as in Example 8 except for changing the conditions to those shown in Table 3B.

For the image forming member thus obtained, an image was formed on a transfer paper according to the same procedure and under the same conditions as in Example 8, whereby a very clear image quality was obtained.

EXAMPLE 11

Image forming members for electrophotography were prepared, respectively, according to the same procedure as in Example 8 except for changing the contents of germanium atoms contained in the first layer as shown in Table 4B by varying the flow rate ratio of $GeH_4$/He gas to $SiH_4$/He gas.

For the image forming members thus obtained, images were formed on transfer papers according to the same procedure and under the same conditions as in Example 8 to obtain the results as shown in Table 4B.

EXAMPLE 12

Image forming members for electrophotography were prepared, respectively, according to the same procedure as in Example 8 except for changing the layer thickness of the first layer as shown in Table 5B.

For the image forming members thus obtained, images were formed on transfer papers according to the same procedure and under the same conditions as in Example 8 to obtain the results as shown in Table 5B.

EXAMPLE 13

By means of the device as shown in FIG. 2, layers were formed on a cylindrical aluminum substrate under the conditions shown in Table 6B to obtain an image forming member for electrophotography.

The thus obtained image forming member was set in an experimental device for charging exposure and corona charging was effected at ⊖5.0 KV for 0.3 sec., followed immediately by irradiation of a light image. The light image was irradiated by use of a tungsten lamp light source at a dose of 2 lux. sec through a transmissive type test chart.

Immediately thereafter, a negatively charged developer (containing toner and carrier) was cascaded on the surface of the image forming member to obtain a good toner image on the surface of the image forming member. When the toner image on the image forming member was transferred by ⊕5.0 KV corona charging to a transfer paper, a clear image of high density excellent in resolution with good gradation reproducibility was obtained.

EXAMPLE 14

By means of the device as shown in FIG. 2, layers were formed on a cylindrical aluminum substrate under the conditions shown in Table 7B to obtain an image forming member for electrophotography.

The thus obtained image forming member was set in an experimental device for charging exposure and corona charging was effected at ⊖5.0 KV for 0.3 sec., followed immediately by irradiation of a light image. The light image was irradiated by use of a tungsten lamp light source at a dose of 2 lux.sec through a transmissive type test chart.

Immediately thereafter, a positively charged developer (comprising toner and carrier) was cascaded on the surface of the image forming member to obtain a good toner image on the surface of the image forming member. When the toner image on the image forming member was transferred by ⊖5.0 KV corona charging to a transfer paper, a clear image of high density excellent in resolution with good gradation reproducibility was obtained.

EXAMPLE 15

By means of the device as shown in FIG. 2, layers were formed on a cylindrical aluminum substrate under the conditions shown in Table 8B to obtain an image forming member for electrophotography.

The thus obtained image forming member was set in an experimental device for charging exposure and corona charging was effected at ⊖5.0 KV for 0.3 sec., followed immediately by irradiation of a light image. The light image was irradiated by use of a tungsten lamp light source at a dose of 2 lux.sec through a transmissive type test chart.

Immediately thereafter, a positively charged developer (comprising toner and carrier) was cascaded on the surface of the image forming member to obtain a good toner image on the surface of the image forming member. When the toner image on the image forming member was transferred by ⊖5.0 KV corona charging to a transfer paper, a clear image of high density excellent in resolution with good gradation reproduciblity was obtained.

EXAMPLE 16

By means of the device shown in FIG. 2, an image forming member for electrophotography was prepared according to the same procedure as in Example 8 except for changing the conditions to those as shown in Table 9B.

For the image forming member thus obtained, an image was formed on a transfer paper according to the same procedure and under the same conditions as in Example 8, whereby a very clear image quality was obtained.

EXAMPLE 17

By means of the device shown in FIG. 2, an image forming member for electrophotography was prepared according to the same procedure as in Example 8 except for changing the conditions to those as shown in Table 10B.

For the image forming member thus obtained, an image was formed on a transfer paper according to the same procedure and under the same conditions as in Example 8, whereby a very clear image quality was obtained.

EXAMPLE 18

In Example 8, an electrostatic image was formed by use of a GaAs type semiconductor laser having 810 nm wavelength (10 mW) was employed as the light source in place of the tungsten lamp, following otherwise the same toner image forming conditions as in Example 8, to prepare an image forming member for electrophotography. When image quality evaluation was conducted for the image forming member obtained, the image obtained was found to be excellent in resolution and of high quality, which was clear with good gradation reproducibility.

The common layer forming conditions in the above Examples of the present invention are shown below:

Discharging frequency: 13.56 MHz

Inner pressure in the reaction chamber during reaction: 0.3 Torr

TABLE 1A

| Layer constitution | Gases employed | Flow rate (SCCM) | Flow rate ratio | Discharging power (W/cm²) | Layer formation speed (Å/sec) | Layer thickness (μ) | Substrate temp. (°C.) |
|---|---|---|---|---|---|---|---|
| First layer | $GeH_4/He = 0.05$ | $GeH_4 = 10$ | — | 0.2 | 3 | 0.1 | 450 |

TABLE 1A-continued

| Layer constitution | Gases employed | Flow rate (SCCM) | Flow rate ratio | Discharging power (W/cm²) | Layer formation speed (Å/sec) | Layer thickness (μ) | Substrate temp. (°C.) |
|---|---|---|---|---|---|---|---|
| Second layer | $SiH_4/He = 0.05$<br>$GeH_4/He = 0.05$ | $SiH_4 + GeH_4 = 50$ | $GeH_4/SiH_4 = 1$ | 0.18 | 5 | 3 | 250 |
| Third layer | $SiH_4/He = 0.5$ | $SiH_4 = 200$ | — | 0.18 | 15 | 15 | 250 |

TABLE 2A

| Layer constitution | Gases employed | Flow rate (SCCM) | Flow rate ratio | Discharging power (W/cm²) | Layer formation speed (Å/sec) | Layer thickness (μ) | Substrate temp. (°C.) |
|---|---|---|---|---|---|---|---|
| First layer | $GeH_4/He = 0.05$ | $GeH_4 = 10$ | | 0.2 | 3 | 0.1 | 450 |
| Second layer | $SiH_4/He = 0.05$<br>$GeH_4/He = 0.05$ | $SiH_4 + GeH_4 = 50$ | $GeH_4/SiH_4 = 0.1$ | 0.18 | 5 | 20 | 250 |
| Third layer | $SiH_4/He = 0.5$ | $SiH_4 = 200$ | | 0.18 | 15 | 5 | 250 |

TABLE 3A

| Layer constitution | Gases employed | Flow rate (SCCM) | Flow rate ratio | Discharging power (W/cm²) | Layer formation speed (Å/sec) | Layer thickness (μ) | Substrate temp. (°C.) |
|---|---|---|---|---|---|---|---|
| First layer | $SiH_4/He = 0.05$<br>$GeH_4/He = 0.05$ | $SiH_4 + GeH_4 = 10$ | $GeH_4/SiH_4 = 3$ | 0.2 | 3 | 0.2 | 450 |
| Second layer | $SiH_4/He = 0.05$<br>$GeH_4/He = 0.05$ | $SiH_4 + GeH_4 = 50$ | $GeH_4/SiH_4 = 0.4$ | 0.18 | 5 | 2 | 250 |
| Third layer | $SiH_4/He = 0.5$<br>$B_2H_6/He = 10^{-3}$ | $SiH_4 = 200$ | $B_2H_6/SiH_4 = 2 \times 10^{-5}$ | 0.18 | 15 | 20 | 250 |

TABLE 4A

| Sample No. | 401A | 402A | 403A | 404A | 405A | 406A | 407A | 408A |
|---|---|---|---|---|---|---|---|---|
| Ge content (atomic %) | 1 | 3 | 5 | 10 | 40 | 60 | 90 | 100 |
| Evaluation | Δ | ○ | ○ | ○ | ◎ | ◎ | ◎ | ◎ |

◎: Excellent
○ : Good
Δ: Practically satisfactory

TABLE 5A

| Sample No. | 501A | 502A | 503A | 504A | 505A | 506A | 507A |
|---|---|---|---|---|---|---|---|
| Layer thickness (μ) | 0.01 | 0.05 | 0.1 | 0.5 | 1 | 2 | 5 |
| Evaluation | Δ | Δ | ◎ | ◎ | ○ | Δ | Δ |

◎: Excellent
○ : Good
Δ: Practically satisfactory

TABLE 6A

| Layer constitution | Gases employed | Flow rate (SCCM) | Flow rate ratio | Discharging power (W/cm²) | Layer formation speed (Å/sec) | Layer thickness (μ) | Substrate temp. (°C.) |
|---|---|---|---|---|---|---|---|
| First layer | $GeH_4/ = 0.05$ | $GeH_4 = 10$ | — | 0.2 | 3 | 0.1 | 500 |
| Second layer | $SiH_4/He = 0.05$<br>$GeH_4/He = 0.05$ | $SiH_4 + GeH_4 = 50$ | $GeH_4/SiH_4 = 1$ | 0.18 | 5 | 2 | 250 |
| Third layer | $SiH_4/He = 0.5$<br>$PH_3/He = 10^{-3}$ | $SiH_4 = 200$ | $PH_3/SiH_4 = 1 \times 10^{-7}$ | 0.18 | 15 | 20 | 250 |

TABLE 1B

| Layer constitution | Gases employed | Flow rate (SCCM) | Flow rate ratio | Discharging power (W/cm²) | Layer formation speed (Å/sec) | Layer thickness (μ) | Substrate temp. (°C.) |
|---|---|---|---|---|---|---|---|
| First layer | $GeH_4/He = 0.05$ | $GeH_4 = 10$ | — | 0.2 | 3 | 0.1 | 450 |
| Second layer | $SiH_4/He = 0.05$<br>$GeH_4/He = 0.05$<br>$B_2H_6He = 10^{-3}$ | $SiH_4 + GeH_4 = 50$ | $GeH_4/SiH_4 = 3/10$<br>$B_2H_6/(GeH_4 + SiH_4) = 3 \times 10^{-3}$ | 0.18 | 5 | 1 | 250 |

TABLE 1B-continued

| Layer constitution | Gases employed | Flow rate (SCCM) | Flow rate ratio | Discharging power (W/cm²) | Layer formation speed (Å/sec) | Layer thickness (μ) | Substrate temp. (°C.) |
|---|---|---|---|---|---|---|---|
| Third layer | $SiH_4/He = 0.5$ | $SiH_4 = 200$ | — | 0.18 | 15 | 20 | 250 |

TABLE 2B

| Layer constitution | Gases employed | Flow rate (SCCM) | Flow rate ratio | Discharging power (W/cm²) | Layer formation speed (Å/sec) | Layer thickness (μ) | Substrate temp. (°C.) |
|---|---|---|---|---|---|---|---|
| First layer | $SiH_4/He = 0.05$<br>$GeH_4/He = 0.05$ | $SiH_4 + GeH_4 = 32$ | $GeH_4/SiH_4 = 5/10$<br>$B_2H_6/(GeH_4 + SiH_4) = 3 \times 10^{-3}$ | 0.2 | 8 | 0.2 | 450 |
| Second layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 1/10$<br>$B_2H_6/(GeH_4 + SiH_4) = 3 \times 10^{-3}$ | 0.18 | 5 | 1 | 250 |
| Third layer | $SiH_4/He = 0.05$<br>$GeH_4/He = 0.05$ | $SiH_4 + GeH_4 = 50$ | $GeH_4/SiH_4 = 1/10$ | 0.18 | 5 | 19 | 250 |
| Fourth layer | $SiH_4/He = 0.5$ | $SiH_4 = 200$ | — | 0.18 | 15 | 5 | 250 |

TABLE 3B

| Layer constitution | Gases employed | Flow rate (SCCM) | Flow rate ratio | Discharging power (W/cm²) | Layer formation speed (Å/sec) | Layer thickness (μ) | Substrate temp. (°C.) |
|---|---|---|---|---|---|---|---|
| First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 5/10$<br>$B_2H_6/(GeH_4 + SiH_4) = 5 \times 10^{-3}$ | 0.18 | 5 | 0.1 | 450 |
| Second layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 3/10$<br>$B_2H_6/(GeH_4 + SiH_4) = 5 \times 10^{-3}$ | 0.18 | 5 | 2 | 250 |
| Third layer | $SiH_4/He = 0.5$<br>$B_2H_6/He = 10^{-3}$ | $SiH_4 = 200$ | $B_2H_6/SiH_4 = 2 \times 10^{-4}$ | 0.18 | 15 | 20 | 250 |

TABLE 4B

| Sample No. | 401B | 402B | 403B | 404B | 405B | 406B | 407B | 408B | 409B | 410B | 411B |
|---|---|---|---|---|---|---|---|---|---|---|---|
| $GeH_4/SiH_4$ Flow rate ratio | 5/100 | 1/10 | 2/10 | 4/10 | 5/10 | 7/10 | 8/10 | 1/1 | 10/1 | 100/1 | $GeH_4$ 100% |
| Ge content (atomic %) | 4.3 | 8.4 | 15.4 | 26.7 | 32.3 | 38.9 | 42 | 47.6 | 70.4 | 98.1 | 100% |
| Evaluation | ○ | ○ | ○ | ○ | ◎ | ◎ | ◎ | ◎ | ◎ | ◎ | ◎ |

◎: Excellent
○ : Good

TABLE 5B

| Sample No. | 501B | 502B | 503B | 504B | 505B | 506B | 507B | 508B |
|---|---|---|---|---|---|---|---|---|
| Layer thickness | 30Å | 500Å | 0.1μ | 0.3μ | 0.8μ | 3μ | 4μ | 5μ |
| Evaluation | Δ | ○ | ◎ | ◎ | ◎ | ○ | ○ | Δ |

◎: Excellent
○ : Good
Δ: Practically satisfactory

TABLE 6B

| Layer constitution | Gases employed | Flow rate (SCCM) | Flow rate ratio | Discharging power (W/cm²) | Layer formation speed (Å/sec) | Layer thickness (μ) | Substrate temp. (°C.) |
|---|---|---|---|---|---|---|---|
| First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 10/1$<br>$B_2H_6/(GeH_4 + SiH_4) = 5 \times 10^{-3}$ | 0.18 | 5 | 0.1 | 450 |
| Second layer | $SiH_4/He = 0.05$<br>$GeH_4/He = 0.05$ | $SiH_4 + GeH_4 = 50$ | $GeH_4/SiH_4 = 5/10$<br>$B_2H_6/(GeH_4 + SiH_4) = 5 \times 10^{-3}$ | 0.18 | 5 | 2 | 250 |

TABLE 6B-continued

| Layer constitution | Gases employed | Flow rate (SCCM) | Flow rate ratio | Discharging power (W/cm²) | Layer formation speed (A/sec) | Layer thickness (μ) | Substrate temp. (°C.) |
|---|---|---|---|---|---|---|---|
| Third layer | $B_2H_6/He = 10^{-3}$<br>$SiH_4/He = 0.5$<br>$PH_3/He = 10^{-3}$ | $SiH_4 = 200$ | $PH_3/SiH_4 = 9 \times 10^{-5}$ | 0.18 | 15 | 20 | 250 |

TABLE 7B

| Layer constitution | Gases employed | Flow rate (SCCM) | Flow rate ratio | Discharging power (W/cm²) | Layer formation speed (A/sec) | Layer thickness (μ) | Substrate temp. (°C.) |
|---|---|---|---|---|---|---|---|
| First layer | $SiH_4/He = 0.05$<br>$GeH_4/He = 0.05$<br>$PH_3/He = 10^{-3}$ | $SiH_4 + GeH_4 = 50$ | $GeH_4/SiH_4 = 10/1$<br>$PH_3/(GeH_4 + SiH_4) = 8 \times 10^{-4}$ | 0.18 | 5 | 0.1 | 450 |
| Second layer | $SiH_4/He = 0.05$<br>$GeH_4/He = 0.05$<br>$PH_3He = 10^{-3}$ | $SiH_4 + GeH_4 = 50$ | $GeH_4/SiH_4 = 5/10$<br>$PH_3/(GeH_4 + SiH_4) = 8 \times 10^{-4}$ | 0.18 | 5 | 15 | 250 |
| Third layer | $SiH_4/He = 0.5$<br>$B_2H_6/He = 10^{-3}$ | $SiH_4 = 200$ | $B_2H_6/SiH_4 = 1 \times 10^{-4}$ | 0.18 | 15 | 5 | 250 |

TABLE 8B

| Layer constitution | Gases employed | Flow rate (SCCM) | Flow rate ratio | Discharging power (W/cm²) | Layer formation speed (A/sec) | Layer thickness (μ) | Substrate temp. (°C.) |
|---|---|---|---|---|---|---|---|
| First layer | $SiH_4/He = 0.05$<br>$GeH_4/He = 0.05$<br>$PH_3/He = 10^{-3}$ | $SiH_4 + GeH_4 = 50$ | $GeH_4/SiH_4 = 10/1$<br>$PH_3/(GeH_4 + SiH_4) = 9 \times 10^{-4}$ | 0.18 | 5 | 0.3 | 450 |
| Second layer | $SiH_4/He = 0.05$<br>$GeH_4/He = 0.05$<br>$PH_3/He = 10^{-3}$ | $SiH_4 + GeH_4 = 50$ | $GeH_4/SiH_4 = 3/10$<br>$PH_3/(GeH_4 + SiH_4) = 9 \times 10^{-4}$ | 0.18 | 5 | 1 | 250 |
| Third layer | $SiH_4/He = 0.5$<br>$B_2H_6/He = 10^{-3}$ | $SiH_4 = 200$ | $B_2H_6/SiH_4 = 9 \times 10^{-4}$ | 0.18 | 15 | 15 | 250 |

TABLE 9B

| Layer constitution | Gases employed | Flow rate (SCCM) | Flow rate ratio | Discharging power (W/cm²) | Layer formation speed (A/sec) | Layer thickness (μ) | Substrate temp. (°C.) |
|---|---|---|---|---|---|---|---|
| First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 10/1$<br>$B_2H_6/(GeH_4 + SiH_4) = 9 \times 10^{-4}$ | 0.18 | 7 | 1 | 450 |
| Second layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 1/10$<br>$B_2H_6/(GeH_4 + SiH_4) = 9 \times 10^{-4}$ | 0.18 | 5 | 15 | 250 |
| Third layer | $SiH_4/He = 0.5$<br>$B_2H_6/He = 10^{-3}$ | $SiH_4 = 200$ | $B_2H_6/SiH_4 = 9 \times 10^{-4}$ | 0.18 | 15 | 5 | 250 |

TABLE 10B

| Layer constitution | Gases employed | Flow rate (SCCM) | Flow rate ratio | Discharging power (W/cm²) | Layer formation speed (A/sec) | Layer thickness (μ) | Substrate temp. (°C.) |
|---|---|---|---|---|---|---|---|
| First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 100/1$<br>$B_2H_6/(GeH_4 + SiH_4) = 2 \times 10^{-4}$ | 0.18 | 7 | 0.1 | 450 |
| Second layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 3/10$<br>$B_2H_6/(GeH_4 + SiH_4) = 2 \times 10^{-4}$ | 0.18 | 5 | 2 | 250 |
| Third layer | $SiH_4/He = 0.5$<br>$B_2H_6/He = 10^{-3}$ | $SiH_4 = 200$ | $B_2H_6/SiH_4 = 2 \times 10^{-4}$ | 0.18 | 15 | 20 | 250 |

What is claimed is:

1. A photoconductive member comprising a support and a light receiving layer comprising a first layer region comprising at least germanium atoms, the content of said germanium atoms being $1-1\times10^6$ atomic ppm, and said layer region being crystallized at least in a portion thereof, and having a thickness of 30 Å – 50 um, a second region comprising an amorphous material comprising at least both of silicon atoms and germanium atoms said content of germanium atoms in the second layer region being $1\times9.5\times10^5$ atomic ppm, and said region having a thickness of 30 Å – 50 um, and a third layer region comprising an amorphous material comprising at least silicon atoms and exhibiting photoconductivity said layer regions being provided successively in this order from the said support side.

2. A photoconductive member according to claim 1, wherein either one of the first layer region, the second layer region and the third layer region comprises hydrogen atoms.

3. A photoconductive member according to claim 1, wherein either one of the first layer region, the second layer region and the third layer region comprises halogen atoms.

4. A photoconductive member according to claim 1, wherein at least one of the first layer region and the second layer region comprises a substance (D) for controlling the electroconductive characteristics.

5. A photoconductive member according to claim 4, wherein the substance (D) for controlling the electroconductive characteristics is an atom belonging to the group III of the periodic table.

6. A photoconductive member according to claim 4, wherein the substance (D) for controlling the electroconductive characteristics is an atom belonging to the group V of the periodic table.

7. A photoconductive member according to claim 1, wherein the third layer region comprises a substance (D) for controlling the electroconductive characteristics.

8. A photoconductive member according to claim 1, wherein the light-receiving layer has a layer region (PN) comprising at least one of p-type impurity and n-type impurity, said layer region (PN) being provided at least at a part of the second layer region.

9. A photoconductive member according to claim 8, wherein the layer region (PN) comprises a p-type impurity.

10. A photoconductive member according to claim 9, wherein the content of the p-type impurity in the layer region (PN) is 0.01 to $5\times10^4$ atomic ppm.

11. A photoconductive member according to claim 8, wherein the layer region (PN) comprises an n-type impurity.

12. A photoconductive member according to claim 11, wherein the content of the n-type impurity in the layer region (PN) is 0.01 to $5\times10^4$ atomic ppm.

13. A photoconductive member according to claim 9, wherein the content of the p-type impurity is 30 atomic ppm or more.

14. A photoconductive member according to claim 11, wherein the content of the n-type impurity is atomic ppm or more.

15. A photoconductive member according to claim 9, wherein there is provided a layer region (Z) comprising an n-type impurity in contact with the layer region (PN).

16. A photoconductive member according to claim 9, wherein a layer region (Z) comprising a p-type impurity is provided in contact with the layer region (PN) in an amount smaller than in the layer region (PN).

17. A photoconductive member according to claim 11, wherein a layer region (Z) comprising a p-type impurity is provided in contact with the layer region (PN).

18. A photoconductive member according to claim 11, wherein a layer region (Z) comprising an n-type impurity is provided in contact with the layer region (PN) in an amount smaller than in the layer region (PN).

19. A photoconductive member according to claim 15, wherein the content of the n-type impurity is 0.001 to 1000 atomic ppm.

20. A photoconductive member according to claim 16, wherein the content of the p-type impurity is 0.001 to 1000 atomic ppm.

21. A photoconductive member according to claim 17, wherein the content of the p-type impurity is 0.001 to 1000 atomic ppm.

22. A photoconductive member according to claim 18, wherein the content of the n-type impurity is 0.001 to 1000 atomic ppm.

23. A photoconductive member according to claim 1, wherein the third layer region has a layer thickness of 0.5 to 90 $\mu$.

24. A photoconductive member according to claim 1, wherein there is the relation of $T_B/T \leqq 1$ between the layer thickness $T_B$ of the second layer region and the layer thickness T of the third layer region.

25. A photoconductive member according to claim 1, wherein the first region has a layer thickness of 30 $\mu$ or less.

26. A photoconductive member according to claim 1, wherein the first layer region comprises 0.0001 to 40 atomic % of hydrogen atoms.

27. A photoconductive member according to claim 1, wherein the first layer region comprises 0.0001 to 40 atomic % of halogen atoms.

28. A photoconductive member according to claim 1, wherein the first layer region comprises 0.0001 to 40 atomic % of hydrogen atoms and halogen atoms as the total amount thereof.

29. A photoconductive member according to claim 1, wherein the second layer region comprises 0.01 to 40 atomic % of hydrogen atoms.

30. A photoconductive member according to claim 1, wherein the second layer region comprises 0.01 to 40 atomic % of halogen atoms.

31. A photoconductive member according to claim 1, wherein the second layer region comprises 0.01 to 40 atomic % of hydrogen atoms and halogen atoms as the total amount thereof.

32. A photoconductive member according to claim 1, wherein the third layer region comprises 1 to 40 atomic % of hydrogen atoms.

33. A photoconductive member according to claim 1, wherein the third layer region comprises 1 to 40 atomic % of halogen atoms.

34. A photoconductive member according to claim 1, wherein the second layer region comprises 1 to 40 atomic % of hydrogen atoms and halogen atoms as the total amount thereof.

35. A photoconductive member according to claim 1, wherein the support is a rotatable member.

* * * * *

UNITED STATES PATENT AND TRADEMARK OFFICE

CERTIFICATE OF CORRECTION

PATENT NO. : 4,569,894

DATED : FEBRUARY 11, 1986

INVENTOR(S) : KEISHI SAITOH, ET AL.

It is certified that error appears in the above-identified patent and that said Letters Patent is hereby corrected as shown below:

AT [57] IN THE ABSTRACT

Line 8 to 9, "photoconductivity said" should read --photoconductivity, said--.

COLUMN 8

Line 32 to 33, "of target comprising a mixture of Si and Ge, a a starting gas for Ge supply optionally diluted with" should read --of a target comprising a mixture of Si and Ge, a starting gas for Ge supply optionally diluted with--.

Line 43, "poly-crystalline silicone" should read --polycrystalline silicon--.

COLUMN 14

Line 33, "the substrate" should read --the substrate 237.--

COLUMN 15

Line 47, "electrophoto-graphy." should read --electrophotography.--.

COLUMN 16

Line 43, "resepctively," should read --respectively,--.

UNITED STATES PATENT AND TRADEMARK OFFICE

CERTIFICATE OF CORRECTION

PATENT NO. : 4,569,894

DATED : FEBRUARY 11, 1986

INVENTOR(S) : KEISHI SAITOH, ET AL.

It is certified that error appears in the above-identified patent and that said Letters Patent is hereby corrected as shown below:

COLUMN 21

Line 17, "$SiH_4+GeH_4=32$" should read --$SiH_4+GeH_4=50$--.
Line 18, "First $SiH_4/He = 0.05$
layer $GeH_4/He = 0.05$" should read
--First $SiH_4/He = 0.05$
layer $GeH_4/He = 0.05$
$B_2H_6/He = 10^{-3}$--.

COLUMN 25

Line 4, "30Å-50um," should read --30Å-50μ--.
Line 7, "atoms said" should read --atoms, said--.
Line 8, "1x9.5x$10^5$" should read --1-9.5x$10^5$--.
Line 9, "30Å-50um," should read --30Å-50μ--.
Line 12, "photocon-ductivity said" should read
--photoconductivity, said--.
Line 59, "is atomic" should read --is 30 atomic--.

COLUMN 26

Line 31 to 32, "or less." should read --or less.--.

Signed and Sealed this

Thirty-first Day of March, 1987

*Attest:*

DONALD J. QUIGG

*Attesting Officer*

*Commissioner of Patents and Trademarks*